US005813392A

United States Patent [19]

McCaslin

[11] Patent Number: 5,813,392

[45] Date of Patent: Sep. 29, 1998

[54] COMPRESSED GAS GUN

[76] Inventor: John A. McCaslin, 4104 Steeplewood Ct., Arlington, Tex. 76016

[21] Appl. No.: 2,573

[22] Filed: Jan. 3, 1998

[51] Int. Cl.[6] ..... F41B 11/00

[52] U.S. Cl. ..... 124/73; 124/76

[58] Field of Search ..... 124/70, 71, 73, 124/74, 76; 42/54

[56] References Cited

U.S. PATENT DOCUMENTS

| | | | |
|---|---|---|---|
| 3,494,344 | 2/1970 | Vadas et al. | 124/11 |
| 3,542,008 | 11/1970 | Vadas et al. | 124/11 |
| 4,539,969 | 9/1985 | Saxby | 124/57 |
| 5,224,465 | 7/1993 | Milliman | 124/76 |
| 5,497,758 | 3/1996 | Dobbins et al. | 124/73 |
| 5,572,982 | 11/1996 | Williams | 124/74 |
| 5,586,545 | 12/1996 | McCaslin | 124/73 |
| 5,711,286 | 1/1998 | Petrosyan et al. | 124/73 |

*Primary Examiner*—J. Woodrow Eldred
*Attorney, Agent, or Firm*—Daniel R. Brown

[57] ABSTRACT

A compressed gas gun is disclosed. A slidable breech seal is employed which is operable to seal a breech opening formed in the frame of the gun and lock the gun in a position ready for discharge. Upon discharge, a hammer strikes the breech seal causing a valve to expel compressed gas and discharge the gun. The beech seal is then slid to a second position which serves to cock the gun, expose the breech opening for subsequent loading, and to set a safety device against subsequent discharge. Once cocked, the breech seal is slid to a first position, again sealing said breech opening.

9 Claims, 10 Drawing Sheets

130

COMPRESSED GAS GUN

TECHNICAL FIELD OF THE INVENTION

This invention relates to compressed gas guns. More particularly, this invention relates to a compressed gas gun having a breech seal moveable between and loading and firing position. The breech seal further serves to actuate a valve to propel a projectile.

BACKGROUND OF THE INVENTION

Compressed gas guns operate to release a quantity of compressed gas into the breech of a barrel, which has been pre-loaded with a projectile, thereby propelling the projectile out of the barrel at a relatively high velocity. In practice, such a gun must provide a source of compressed gas in order to be operational. Typically, this source of gas is a tank which is pre-charged prior to being coupled with the gun or a fixed tank which is charged in place while coupled to the gun. In either case, the tank holds a finite quantity of compressed gas. Upon discharging the gun one or more times, the reserve of compressed gas is ultimately depleted and must be replenished.

In the case of a manually loaded compressed gas gun, the breech of the barrel must be accessible for manually inserting a projectile into the breech of the barrel. It is desirable to provide a readily accessible breech which can be conveniently loaded by the fingers of the user.

A valve mechanism is commonly provided which acts to discharge a quantity of compressed gas upon actuation of a trigger mechanism. However, prior to discharging the gun, the valve assembly must be coupled to the breech of the barrel in order to seal the gas port between the tank and the breech of the barrel. It is desirable to provide a tight seal which serves to conserve the amount of gas consumed upon discharging the gun and also to conserve the pressure of the gas so as to maximize the amount of energy transferred from the compressed gas to the projectile. Furthermore, a tight gas seal reduces the sound level of the gun upon discharging, which is desirable in compressed gas guns.

The quantity of parts, particularly precision parts, is a factor in the cost of producing compressed gas guns. Accuracy and repeatability of the projectile trajectory, upon firing, are desirable in compressed gas guns. Precision components and accuracy often go hand in hand. While some users view compressed gas guns as toys, there is a segment of the compressed gas gun market which demands the highest possible level of accuracy and performance in such guns. Indeed, compressed gas guns are used in competitive, hunting and other sporting events where accuracy, efficiency, and durability are of utmost importance. Compressed gas guns offer advantages over conventional fire arms including the lack of any need for an operator's license, low operating cost, and quiet operation.

Various compressed gas guns have been proposed which accomplish the foregoing tasks involved in discharging such a gun. Many of the proposed designs utilize a large quantity of precision parts to produce a high quality gun. Often times, the trigger mechanism, valve assembly, and breech seal require the majority of precision parts. If a compromise is made in the quality of the design or parts, gun quality usually suffers.

U.S. Pat. No. 5,586,545, to this inventor, discloses two embodiments of compressed gas guns which address the forgoing design issues. That patent teaches the design of a compressed gas that utilizes relatively few precision parts, yet provides accurate, repeatable performance. This is accomplished by utilizing either a slidable barrel or slidable breech seal that are spring driven against a valve assembly thereby discharging the gun. In that patent, either the barrel or breech seal is cocked against the force of a spring into a position that allows loading of a projectile and readies the gun for firing. While that design meets the objectives of low cost and accuracy, it has a disadvantage in that the breech remains exposed between the time of loading and firing. In many situations, the user of a gun desires to load the gun and leave it ready for firing for an extended period of time. Having the breech exposed has certain disadvantages including exposure to the elements.

There is a need for a compressed gas gun which improves upon prior designs. Such a gun would offer ease of loading, quiet operation, accuracy, efficiency, and reliability. In addition, the breech opening could be sealed against the elements between the time of loading and discharging of the gun. Further, such a gun would comprise relatively few parts, particularly precision machined parts, while still offering the foregoing advantages.

SUMMARY OF THE INVENTION

The present invention is a compressed gas gun which offers several advantages over prior art designs. The present gun utilizes an easily accessible open breech design that provides for easy loading of the gun. It provides an impact actuated valve assembly. A slidable breech seal is disclosed which operates between a first loading position and a second firing position. The slidable breech seal serves to communicate the impact force of a hammer to the valve assembly, thereby actuating the valve. A tight gas seal between the valve gas port and barrel breech is accomplished by incorporating a valve seal and a barrel seal into the breech seal with a gas conduit providing a sealed passage through which the compressed gas can flow.

The hammer is cocked by manually urging the breech seal forward against the hammer which in turn, compresses a spring. A cocking pawl on the hammer is engaged by a trigger assembly thereby cocking the gun for subsequent firing. A knob extends from the breech seal to the exterior of the frame which facilitates sliding of the breech seal both forward for cocking and rearward for sealing.

Once the gun is cocked, the breech seal is slid rearward to close the breech opening and engage the valve seal with the valve. The barrel is continuously sealed by means of the barrel seal on the breech seal. In the firing position, the breech seal is held in place by rotating the knob thereby engaging a cam formed in the frame.

The gun is discharged by actuating the trigger which releases the cocking pawl. Once released, the hammer is driven by the spring against the breech seal. The breech seal is thus driven against the valve which actuates the valve to expel a quantity of compressed gas out of the gas port in the valve. The compressed gas enters the breech seal and flows through the gas conduit to the breech of the barrel and expels the projectile, discharging the gun.

A novel trigger assembly is disclosed which is compact and comprises a self actuating safety device. Each time the breech seal is moved to the loading position, the safety locks the trigger and the gun cannot be discharged until the safety is manually deactivated.

The present invention is constructed with relatively few parts, as compared to conventional designs, and in particular, a minimum of precision parts. Thermoplastics are used to advantage.

A valve assembly is connected to the frame, at the breech end thereof and in line with the bore of the barrel. When the trigger mechanism is actuated, the cocking pawl is disengaged and the spring forces the hammer toward the breech end of the frame. The hammer impacts the breech seal which further drives valve seal which is spring biased in a closed position, and forces the valve assembly to discharge compressed gas from a compressed gas tank which is connected to an inlet fitting on the valve assembly. The gas is discharged out of a valve gas port in the valve assembly and into the breech seal. The breach seal couples the compressed gas to the breech of the barrel via a breech seal gas conduit. A seal is provided between the breech seal and the barrel beech which prevents the escape of compressed gas, other than through the barrel itself.

In the preferred embodiment, the frame includes a receiver tube that has a breech opening formed into it at a position so that the user of the gun can easily access the breech of the barrel and insert a projectile when the gun is cocked. A receiver tube diameter is selected that also provides adequate size for easy insertion of the projectile. The inside diameter of the receiver tube provides the support surface for the hammer. In general, the barrel and receiver tube are concentric to one another.

In the valve assembly, a valve plunger is provided that moves within a valve frame. The valve plunger is biased toward a valve seal by a valve spring. A valve gas conduit is connected between the valve plunger and a valve gas port at the front of the valve assembly. The valve assembly is threaded and connects directly to the tank. In operation, the hammer impacts the breech seal which further impacts the valve gas port, thereby forcing the valve plunger open and expelling compressed gas. As the breech seal recoils, the valve spring and the force of the compressed gas, force the valve plunger back against the valve seal, thereby closing the valve and preventing subsequent gas expulsion. The valve seal includes an 'O'-ring which seals the valve seal to the valve frame.

BRIEF DESCRIPTION OF THE DRAWINGS

The features of the present invention which are believed to be novel are set forth with particularity in the appended claims. The invention, together with further objects and advantages thereof, may be best understood by making reference to the following description taken in conjunction with the accompanying drawings, in the several figures of which like reference numerals identify identical elements, and wherein:

DETAILED DESCRIPTION

Figure 1:
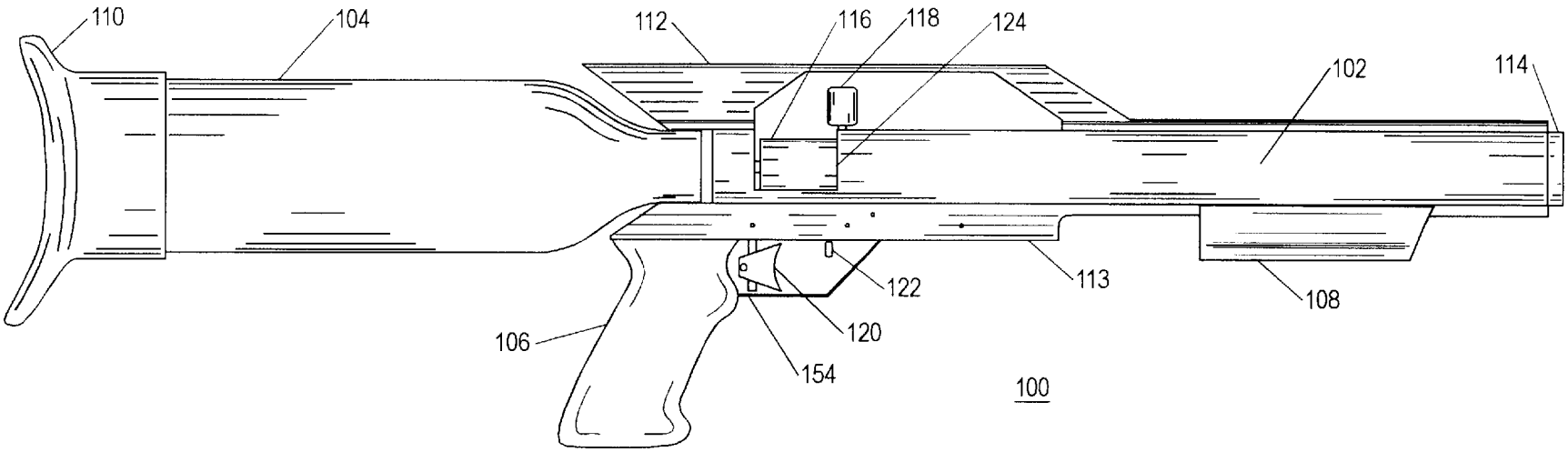
FIG. 1 is a side view of the preferred embodiment of the gun.

Reference is directed to FIG. 1 which is a side view of the preferred embodiment of the gun 100. The gun includes a frame 102 which is formed from an extruded aluminum tube shape. A compressed gas tank 104 is coupled to the frame 102 at the rear, or breech end, of the frame 102. A hand grip 106 extends downward from the frame 102 and is used by a user to hold the gun in conjunction with a fore stock 108 which is attached to the frame 102 near the front, or muzzle end, of the gun. At the rear end of the compressed gas tank 104 is a butt stock 110. The butt stock 110 provides a comfortable surface to rest against the shoulder of the user while operating the gun.

A hand guard 112 is machined from an extension of the frame 102 and serves to protect the cocking knob 118, breech seal 116, and breech opening 124, each of which will be described in further detail hereinafter. In front of the hand grip 106 is a trigger guard 154 which protected the trigger actuator 120 and safety actuator 122, each of which will be described in further detail hereinafter. The muzzle end of the preferred embodiment gun fitted with a muzzle cover 114 which serves to protect the muzzle and provide an exit hole for passage of the projectile which the gun is discharged.

Figure 2:
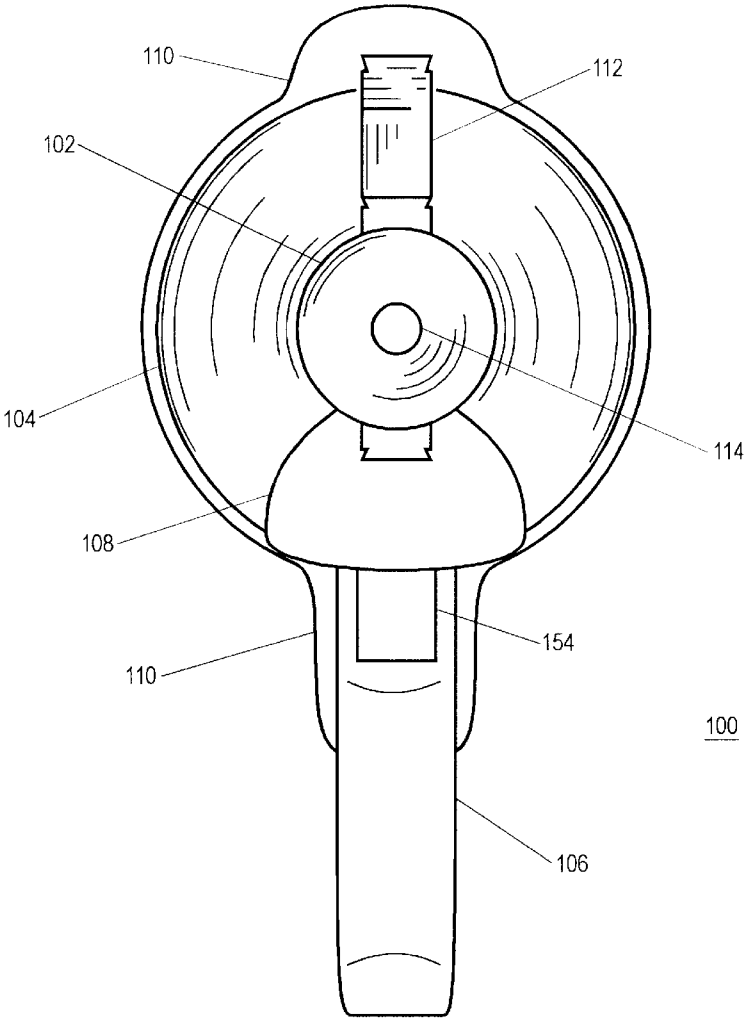
FIG. 2 is a muzzle end view of the preferred embodiment of the gun.

Reference is directed to FIG. 2 which is a muzzle end view of the preferred embodiment gun 100. The exit hole in muzzle cover 114 is visible at the muzzle end of frame 102. Hand guard 112 extends upward from frame 102. Mounting rail 113 extends downward from frame 102. Hand guard 154 extends downward in front of hand grip 106, and is attached to mounting rail 113. Fore stock 108 attaches to the bottom of frame 102 along mounting rail 113. Also visible at the read of gun 100 is the compressed gas tank 104 and butt stock 10. As is apparent in this FIG. 2, many of the components of the gun 100 are arranged concentrically around the centerline of the barrel (not shown in this FIG. 2).

Figure 3A:
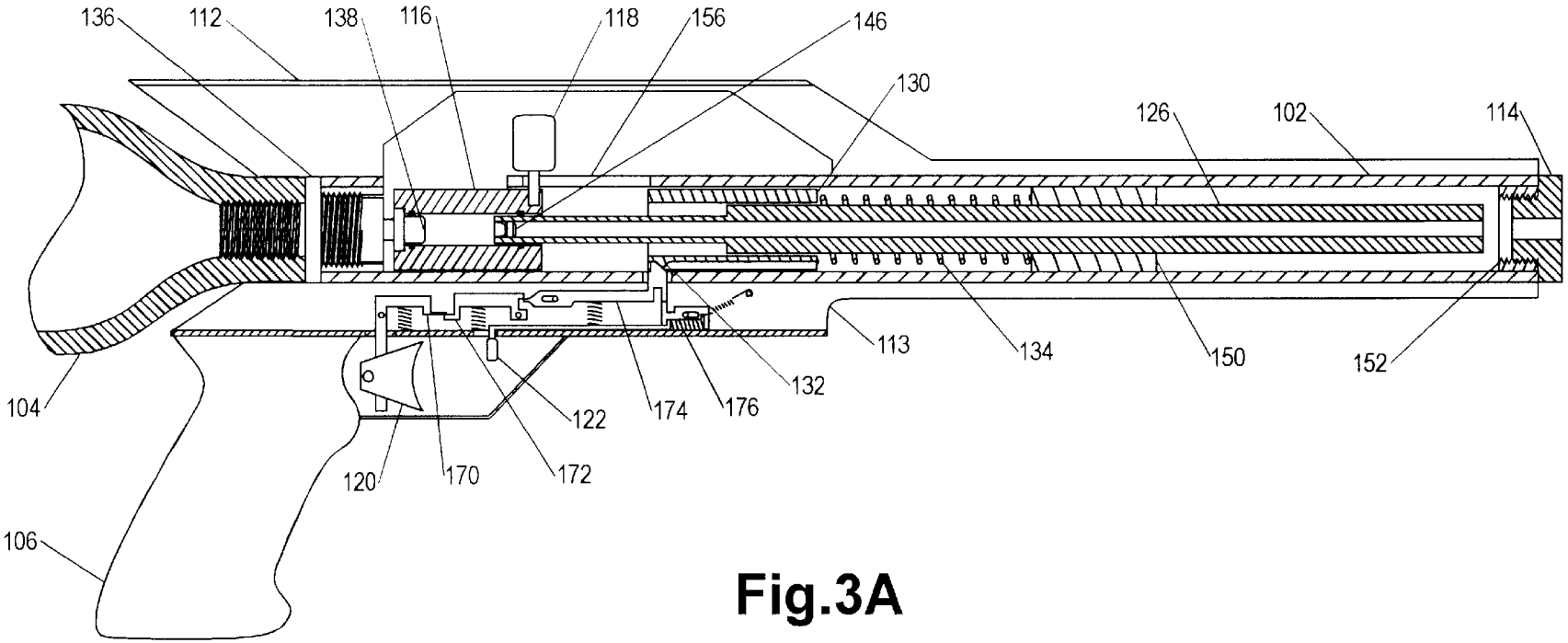
FIG. 3A is a section view of the preferred embodiment of the gun in the cocked and sealed position.
Figure 3B:
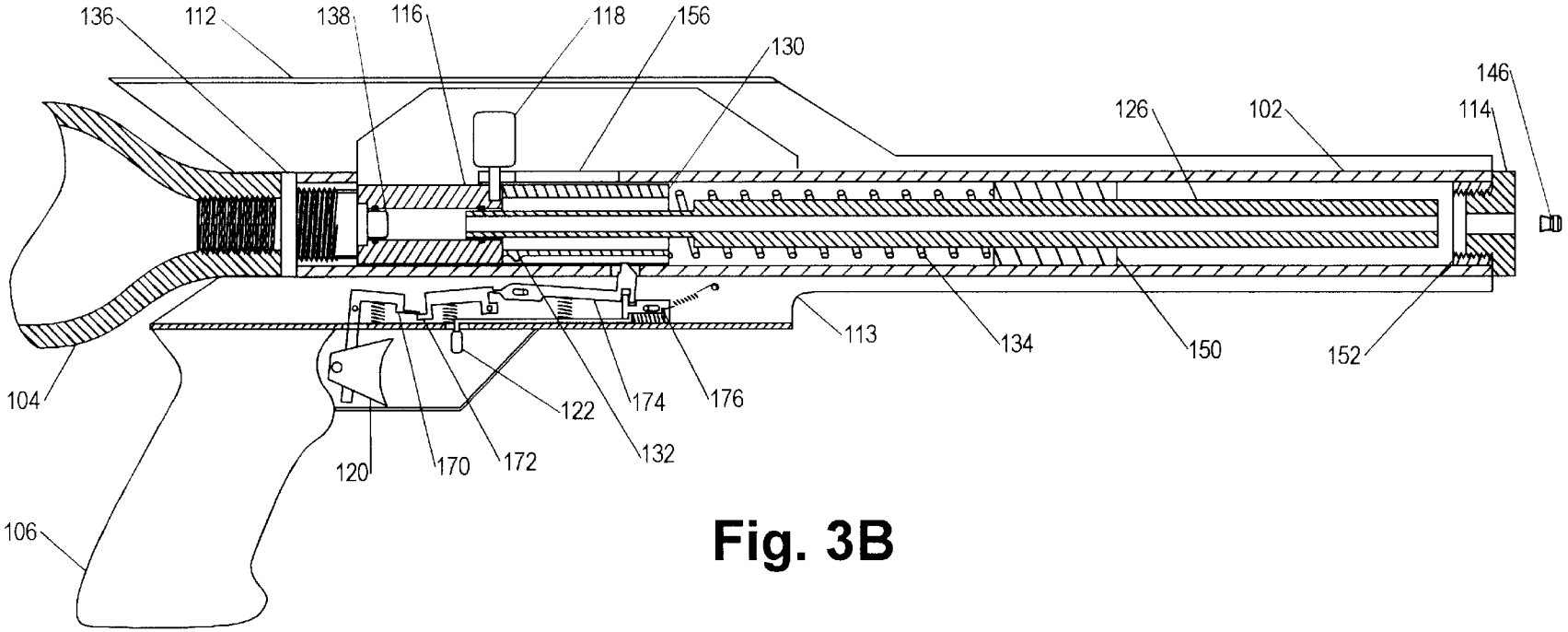
FIG. 3B is a section view of the preferred embodiment of the gun at the moment of discharge.
Figure 3C:
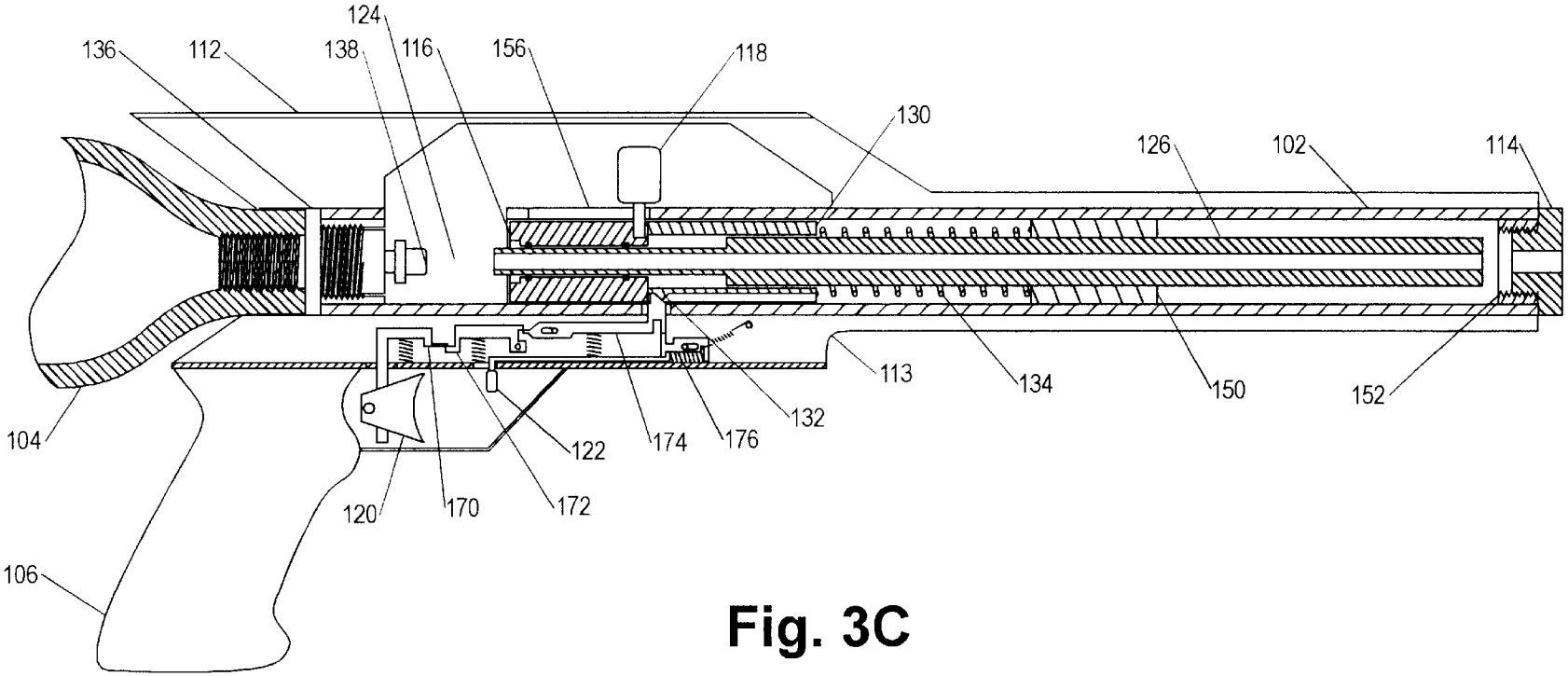
FIG. 3C is a section view of the preferred embodiment of the gun in the cocked position.

Reference is now directed to FIG. 3A which is a cross section of the gun along its centerline. FIGS. 3B and 3C are nearly identical except that the mechanisms within the gun are shown at different points of operation. In this FIG. 3A, the gun is shown in the cocked and sealed position, ready to be discharged.

The preferred embodiment gun is build around an extruded aluminum frame 102 which is tubular in shape and has upward and downward extensions protruding therefrom. Hand guard 112 is machined from the upward extension of frame 102. Mounting rail 113 is machined from the downward extension of frame 102. Hand grip 106 attaches to mounting rail 113.

The rear, or breech end, of frame 102 is threaded to accept valve assembly 136. Valve assembly 136 is, in turn, threaded to accept compressed gas tank 104. At the front, or muzzle end, of frame 102 is inserted muzzle cover insert 152 which is attached to frame 102 and threaded to accept muzzle cover 114. Muzzle cover 114 has a hole formed therein which is substantially larger in diameter than the projectile discharged by the gun for allowing free passage of the projectile upon discharge. Muzzle cover 114 serves to protect the muzzle end of the gun and provide an attractive appearance.

Mounted concentrically within the tubular portion of frame 102 is barrel 126. In the preferred embodiment, the barrel 126 is formed from steel and is rifled to provide a repeatable projectile trajectory. The projectile 146 is shown inserted into the breech of barrel 126. The barrel 126 is rigidly attached to frame 102 by barrel mount 150. Barrel mount 150 also serves as a fixed point for biasing spring 134 against hammer 130.

Figure 4:
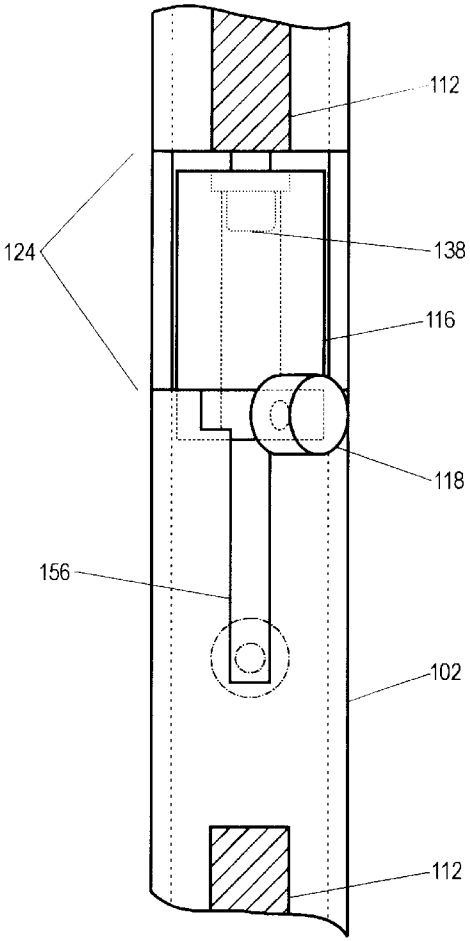
FIG. 4 is a section view of breech opening in the frame of the preferred embodiment of the gun.

Breech seal 116 is slidably mounted along the breech end of barrel 126. An 'O'-ring within breech seal 116 provides a tight gas seal between it and barrel 126. Breech seal 116 has an cocking knob 118 extending from it which extends outside of the tubular portion of frame 102. The cocking knob 118 allows manual operation and movement of breech seal 116. The breach seal 116 is generally freely movable by the user. The beech seal 116 can be locked in the sealed position by rotating cocking knob 118 against a cam formed in a cocking slot 156 formed in frame 102. Details of the cocking slot 156 are shown in FIG. 4. In the cocked and sealed position, as depicted in this FIG. 3A, the breach seal 116 is positioned rearward and is sealed against the valve gas port 138 portion of valve assembly 136. Another 'O'-ring seal the breech seal 116 to the valve gas port 138. Details of the breach seal are described in FIGS. 5A and 5B.

The gun as shown in FIG. 3A is cocked, sealed and ready to discharge. Within a trigger assembly, described hereinafter, is a cocking member 174 which engages a cocking pawl 132 formed in hammer 130. Thus engaged, the hammer 130 is held away from breech seal 116 and against the compression force of spring 134. Breech seal 116 has been manually moved rearward to seal the valve gas port 138 to the breech of barrel 126. Projectile 146 rests within the breech of barrel 126 and the gun is ready for discharge.

Reference is directed to FIG. 3B which is a section view of the preferred embodiment gun at the moment of discharge. The view of the gun in this figure is substantially identical to that in FIG. 3A except that the trigger assembly has now been actuated and the gun discharged.

Discharge of the gun in the preferred embodiment is accomplished by actuation of trigger actuator 120 which causes the trigger assembly, comprising a number of elements including trigger actuator member 170, sear link 172, cocking member 174, and safety link 176, to disengage the cocking pawl 132 formed in hammer 130. Trigger actuation is specifically accomplished by first disengaging the safety mechanism by pulling rearward on safety actuator 122. This causes safety link 176 to move rearward and allow for alignment of safety link 176 and cocking member 174 such that cocking member 174 can rotate and disengage cocking pawl 132. After the safety mechanism has been disengaged, trigger actuator 120 is pulled rearward which causes trigger actuator member 170 to rotate in a clockwise direction as viewed in this FIG. 3B. The rotation of trigger actuator member 170 causes a subsequent rotation in sear link 172 which is sufficient to disengage the sear relationship between sear link 172 and cocking member 174. As the sear disengages, cocking member 174 rotates allowing the forward end thereof to drop downward and disengage the cocking pawl 132. Having disengaged the cocking pawl 132, the hammer is free to move and discharge the gun.

The ultimate effect of this actuation is that hammer 130, being disengaged, is urged rearward by spring 134 and strikes breech seal 116. Breech seal 116 communications the force and momentum of hammer 130 to valve gas port 138 which in turn opens valve assembly 136, thereby expelling compressed gas into breech seal 116. The compressed gas forces the projectile 146 out of the muzzle end of barrel 126, thereby discharging the gun. The force of a spring within valve assembly 136 urges the breech seal forward such that the valve assembly closes and the expulsion of gas ceases. All of the mechanisms within the gun in the preferred embodiment come to rest and the discharge is complete.

Reference is directed to FIG. 3C which is a section view of the preferred embodiment of the gun in the cocked position. After the gun has been discharged, the user manually moves the breech seal 116 forward by rotating it to disengage the cam formed in the cocking slot 156 formed in frame 102 and slides the breech seal 116 forward, to the extent of its travel. This action exposes the breech of barrel 126 within the breech opening 124 formed in frame 102. The ample breech opening 124 allows easy access by the user to insert a projective (not shown in this view) in the breech of barrel 126. In addition to exposing the breech, the action of sliding the breech seal 116 forward causes the breech seal 116 to engage hammer 130 which causes it to also slide forward. When the forward travel is near its limit, cocking pawl 132 in hammer 130 engages cocking member 174 in the trigger assembly. This accomplishes the cocking of the gun. The forward motion of the hammer 130 and cocking pawl 132 also cause a slight forward motion in both cocking member 174 and safety link 176. Springs within the trigger mechanism, which are detailed in FIG. 7, cause the trigger assembly to settle in such a fashion that safety link 176 and cocking member 174 interfere and prevent discharge until the safety is disengaged. See the preceding discussion for details as to how the safety is disengaged.

After the user has inserted a projectile into the breech of barrel 126, the breech seal can be moved rearward, as previously described, and the gun is once again ready for discharge, as detailed in FIG. 3A.

Reference is directed to FIG. 4 which is a section view looking down upon of the breech opening in the frame in the preferred embodiment of the present invention. The frame 102 is visible with the extensions for hand guard 112 present. A breech opening 124 is formed by removing a portion of the tubular section of frame 102. In this FIG. 4, the breech seal 116 is shown in the sealed position such that breech seal 116 engages valve gas port 138. The cocking knob 118 extends through a cocking slot 156 formed in frame 102. The cocking slot 156 is widened to form a cam at the breech opening end such that cocking knob 118 can be rotated to engage that cam so formed. This has the effect of locking the breech seal 116 in the sealed position.

Figure 5B:
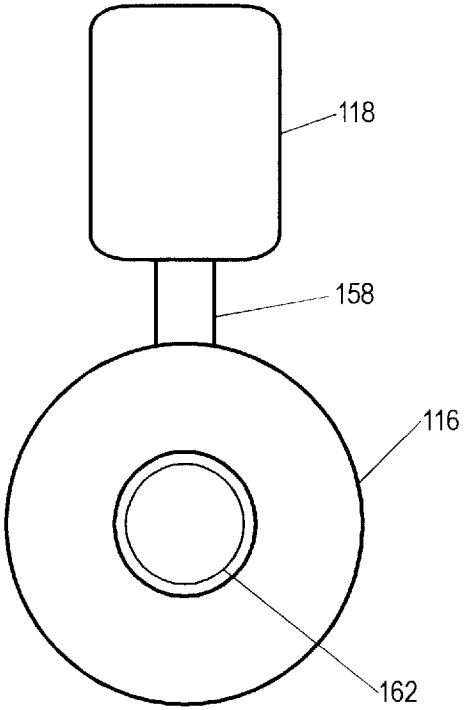
FIGS. 5A and 5B are details of the breech seal in the preferred embodiment of the gun.
Figure 5A:
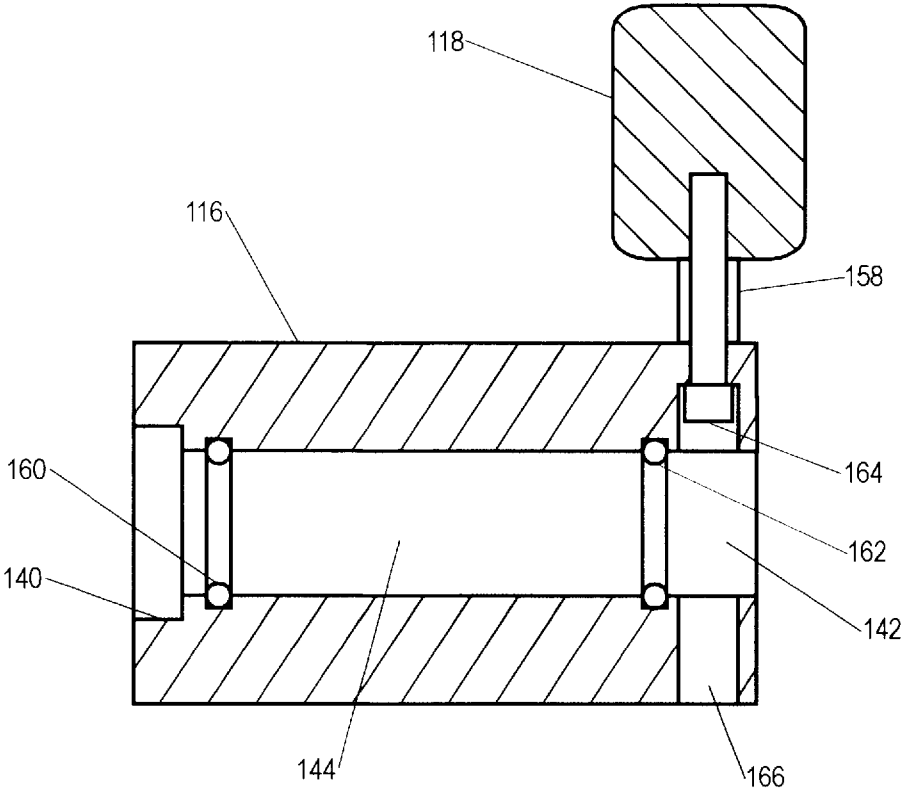

Reference is directed to FIGS. 5A and 5B which detail the breech seal in the preferred embodiment of the present invention. Breech seal 116 includes a cylindrical body made from a thermoplastic material which has a tubular breech seal gas conduit 144 formed therein. At a first end of the breech seal 116 is a breech seal valve opening 140 for engaging the valve gas port 138 (not shown), and, at a second end of breech seal 116 is a breech seal barrel opening 142 for engaging the barrel 126 (not shown). Within the breech seal gas conduit are a first and second annular grove for retaining a valve opening 'O'-ring 160 and a barrel opening "O"-ring 162. The 'O'-rings serve to seal the breech seal 116 against gas leaks during discharge.

A cocking knob 118 is attached to the breech seal 116 via a cocking stem 158 which is retained by cocking knob mounting screw 164. An advantageous design is realized by boring a cocking knob mounting screw installation opening 166 through the diameter of the breech seal 116 body which is of sufficient size to allow passage of the head of the cocking knob mounting screw 164. The barrel opening 'O'-ring 162 is located inside of the cocking knob mounting screw installation opening 166 so that the opening does not leak compressed gas during discharge.

Figure 6B:
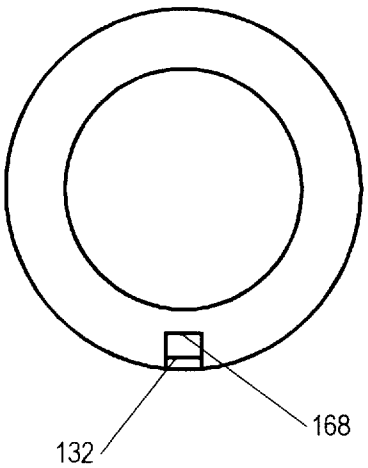
FIGS. 6A and 6B are details of the hammer in the preferred embodiment of the gun.
Figure 6A:
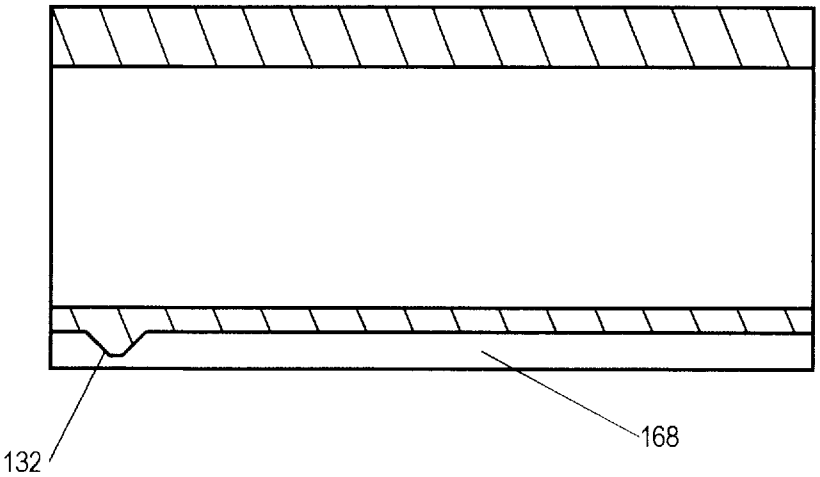

Reference is directed to FIGS. 6A and 6B which are detailed views of the hammer in the preferred embodiment of the present invention. The hammer 130 is fabricated from a tubular thermoplastic material whose outside diameter is slightly smaller than the inside diameter of the tubular frame 102 (not shown). This arrangement of diameters provides that the tubular frame 102 acts to guide the hammer 130 as it moves during operation of the gun. The hammer 130 has a cocking pawl slot 168 which serve to provide clearance for the cocking member 174 (not shown). This also prevents the hammer from rotating during operation. Near the rear, or breech, end of the hammer 130 is formed the cocking pawl 132 that engages the cocking member 174 (not shown) in the trigger assembly (not shown).

Figure 7:
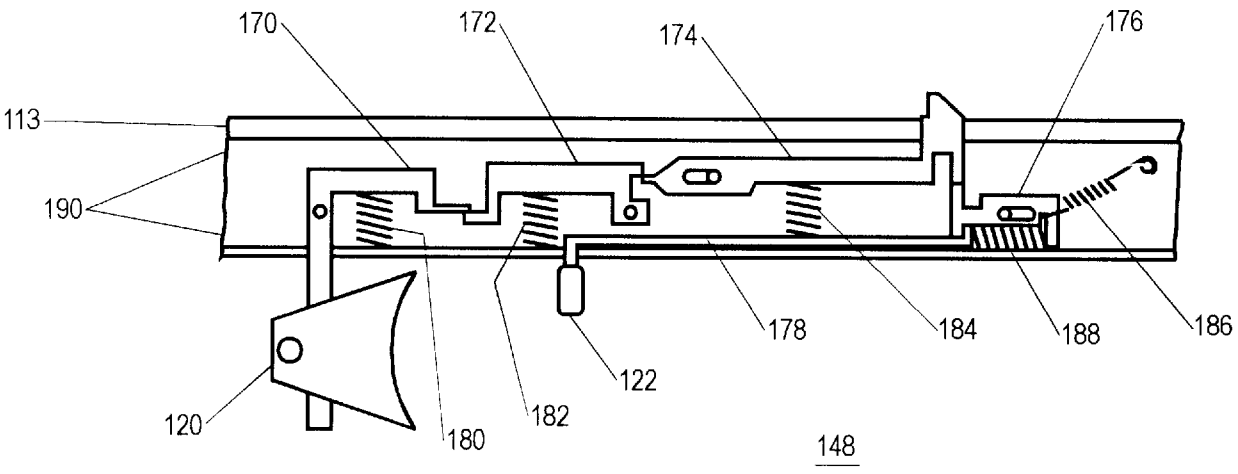
FIGS. 7 is a detail of the trigger assembly of the preferred embodiment in the cocked position.

Reference is directed to FIG. 7 which is a detail of the trigger assembly 148 in the preferred embodiment. The operation of the trigger assembly 148 has been described earlier, this discussion details the various components in the trigger assembly 148. The trigger assembly 148 is mounted in a trigger assembly recess 190 formed in mounting rail 113. A trigger actuator 120 is attached to trigger actuator member 170 that is rotatably mounted to frame rail 113. A trigger actuator spring 180 biases the trigger actuator to a forward position. Trigger actuator member 170 engages sear link 172 which is rotatably mounted in frame rail 113 and which is urged to rotate in a clockwise direction as viewed in this FIG. 7 by sear link spring 182. A sear is formed between sear link 172 and cocking member 174. Cocking member 174 is rotatably and slidably mounted to frame rail 113 and is urged to rotate in a counterclockwise direction as viewed in this FIG. 7 by cocking member spring 184. A safety link 176 is slidably mounted to frame rail 113 and engages cocking member 174 to prevent rotation of same and render the gun inoperable. Safety link 176 is coupled to safety actuator link 178 by safety actuator link spring 188. Safety actuator 122 is attached to the safety actuator link 188 and extends out of frame rail 113 for access by the user. Safety link spring 186 biases safety link 176 forward, toward the muzzle end of the gun, and serves to automatically engage the safety each time the gun is cocked.

Figure 8B:
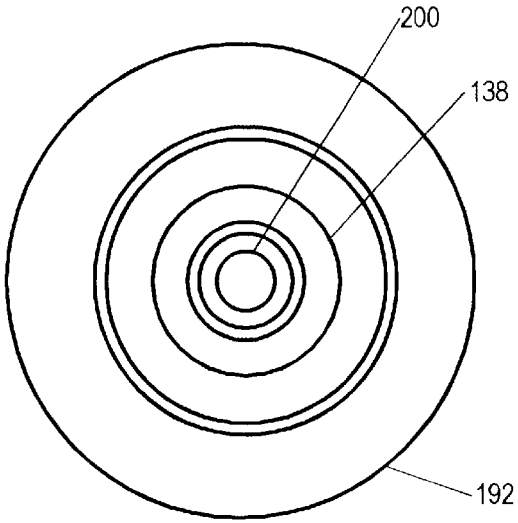
FIGS. 8A, and 8B are details of the valve assembly.
Figure 8A:
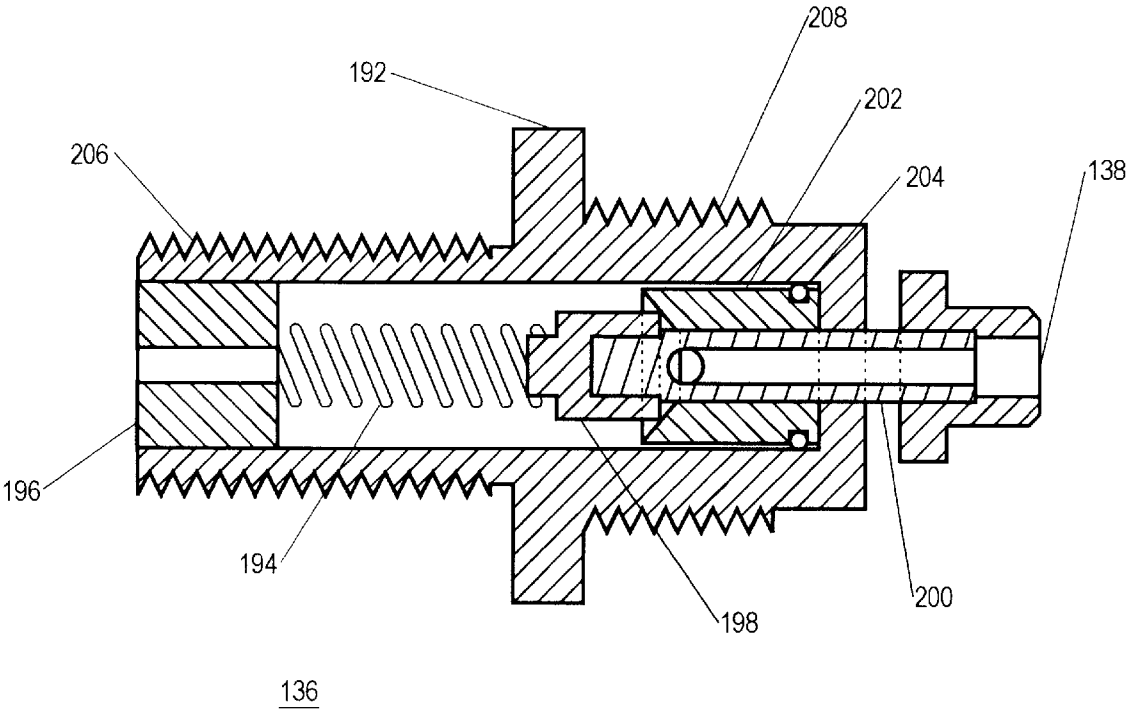

Reference is directed to FIGS. 8A and 8B which are details of the valve assembly in the preferred embodiment. The valve assembly 136 is a poppet type valve which is spring biased to a closed position. The valve assembly includes a valve frame 192 which has tank threads 206 for attachment to the compressed gas tank, and frame threads 208 for attachment to the frame of the gun. The valve frame 192 has a passage formed through it which is sized to accept a valve seal 202 that comprises an valve seal 'O'-ring 204 which seals against the loss of compressed gas. A valve plunger 198 engages the valve seal 202 to form the actual gas valve action. The valve plunger 198 is attached to valve gas conduit 200 which is inter attached to valve gas port 138. These three elements move together when the valve gas port 138 is impacted by valve seal 116 (not shown). The aforesaid three elements are biased to a closed position by valve spring 194 which rests against valve spring retainer 196 attached to an inlet end of valve frame 192. It should be understood that other valve assemblies may be contemplated for accomplishing the same valve function.

I claim:

1. An air gun, comprising:

a frame having a breech opening formed therein;

a barrel having a breech, said barrel attached to said frame such that said breech is accessible through said breech opening;

a hammer mounted within said frame, and having a cocking pawl formed therein;

a spring disposed between said frame and said hammer;

a valve attached to said frame and having a gas port for expelling compressed gas upon actuation of said valve;

a breech seal having a valve opening and a barrel opening formed therein, said breech seal further having a gas conduit formed therein coupling said valve opening to said barrel opening, said breech seal slidably disposed about said barrel between a loading position and a discharge position, and wherein said breech seal exposes a substantial portion of said breech opening when said breech seal is located in said loading position thereby allowing access to said breech though said breech opening for manual loading of a projectile into the breech of said barrel, and wherein said breech seal closes a substantial portion of said breech opening when said breech seal is located in said discharge position;

a trigger assembly attached to said frame and operable to engage said cocking pawl and retain said hammer at a position away from said breech seal, and wherein actuation of said trigger assembly releases said cocking pawl thereby allowing said spring to urge said hammer against said breech seal so as to activate said valve thereby expelling compressed gas through said gas conduit, into said breech, and propelling the projectile.

2. The air gun in claim 1, and wherein said hammer is tubular in form and is mounted concentric to said barrel.

3. The air gun in claim 2, and wherein said hammer has a cocking pawl slot formed in its outside surface along its longitudinal axis, and said cocking pawl slot engages said cocking pawl thereby preventing rotation of said hammer.

4. The air gun in claim 1, and wherein said breech seal gas conduit is tubular in form and said breech seal is sealed to said barrel with an 'O'-ring.

5. The air gun in claim 1, and wherein said breech seal gas conduit is tubular in form and said breech seal is sealed to said valve gas port with an 'O'-ring.

6. The air gun in claim 1, and wherein said breech seal is cylindrical in form and said frame has a cylindrical inside diameter near said breech opening such that said breach seal substantially seals said breech opening from access while said breech seal is in said discharge position.

7. The air gun in claim 1, and wherein said breech seal further comprises a cocking knob which extends through a cocking slot formed in said frame.

8. The air gun in claim 7, and wherein said cocking slot has a cam formed therein for engaging said cocking knob such that said breech seal is locked in said discharge position.

9. The air gun in claim 1, and wherein said hammer is urged against said breech seal which directly drives said valve upon impact by said hammer.

* * * * *